United States Patent [19]

Clarkson

[11] Patent Number: 4,787,460

[45] Date of Patent: Nov. 29, 1988

[54] MOUNTING PLATE FOR A FIRE EXTINGUISHER HAVING A SELF-LOCATION FEATURE

[76] Inventor: Joseph G. Clarkson, 662 Riordan Ter., Towson, Md. 21204

[21] Appl. No.: 39,292

[22] Filed: Apr. 17, 1987

[51] Int. Cl.[4] ..... A62C 11/00

[52] U.S. Cl. ..... 169/51; 169/30; 116/200; 116/2

[58] Field of Search ..... 169/51, 30, 71, 72, 169/76; 40/584, 582; D29/1-5, 99; 116/209, 200, 1, 2, DIG. 1; 248/542, 311.2

[56] References Cited

U.S. PATENT DOCUMENTS

| | | | |
|---|---|---|---|
| D. 250,776 | 1/1979 | Hard | D29/5 |
| D. 252,121 | 6/1979 | Rutherford | D6/573 |
| 1,464,001 | 8/1923 | Iddings | 169/51 X |
| 1,604,380 | 10/1926 | Boyce | 169/57 |
| 2,635,376 | 4/1953 | Allen et al. | 169/30 X |
| 2,965,890 | 12/1960 | Robillard | D29/5 X |
| 3,702,157 | 11/1972 | Thomas | 169/51 |
| 3,722,733 | 3/1973 | Neumann | 169/51 |
| 3,942,669 | 3/1976 | Savage, Jr. | 169/51 |
| 4,016,665 | 4/1977 | Sakota | 40/582 |
| 4,037,814 | 7/1977 | Clausen | 248/311.2 |
| 4,449,588 | 5/1984 | Benlolo et al. | 169/48 |
| 4,598,893 | 7/1986 | Stobbart | 169/51 X |

FOREIGN PATENT DOCUMENTS

| | | | |
|---|---|---|---|
| 755419 | 3/1967 | Canada | 169/51 |

*Primary Examiner*—Joseph F. Peters, Jr.
*Assistant Examiner*—James M. Kannofsky
*Attorney, Agent, or Firm*—Harry Williams

[57] ABSTRACT

A wall mounted plate for a hand-operated fire extinguisher in which the plate has markings thereon to signal to the prospective user its location. The plate is composed of a fiberglass reinforced plastic, the markings thereon being of a striped pattern and integral with the plastic, and the plate further having a planar extension beyond the periphery of the fire extinguisher for effecting maximum visibility.

7 Claims, 1 Drawing Sheet

MOUNTING PLATE FOR A FIRE EXTINGUISHER HAVING A SELF-LOCATION FEATURE

FIELD OF THE INVENTION

This invention relates to mounting brackets for fire extinguishers and particularly to those kinds of brackets which are wall-mounted and designed to support a hand-operated fire extinguisher for immediate use under emergency conditions.

BACKGROUND OF THE INVENTION

Hand-operated fire extinguishers are usually mounted on a wall surface in public places, such as the workplace, public thoroughfares, stairwells, as well as in open areas that might contain inflammable materials and thus contribute to the outbreak of fire. Such fire extinguishers are most usually mounted directly on a wall-surface or on a bracket of some kind which is itself mounted on a wall-surface, so that the fire extinguisher can be easily removed from the bracket used for its intended purpose and then eventually replaced with a substitute on the same wall-bracket.

In the past such brackets were constructed so as to serve the simple utilitarian purpose of supporting the fire extinguisher without any thought given to the need for providing some kind of high profile signal or indication as to the location of the fire extinguisher, especially under those emergency conditions in which the fire extinguisher would actually be used and when the safety of the individuals present is at grave risk. It soon becomes apparent that under such conditions panic prevails and time itself becomes a key factor in determining when and if the threat or the reality of a fire can be dealt with adequately. If, for example, the location of the fire extinguisher is not readily known (which is usually the case) then a last minute attempt to find its location could delay its use, a delay that could well have disastrous consequences. Normally, such fire extinguishers are of a monochrome color, red or brown, for example, and are mounted on a wooden or metal bracket which is equally, if not more so, subdued in appearance. Anyone in a state of panic looking for a fire extinguisher whose immediate whereabouts is not known is not only wasting valuable time in the search but is also subjecting himself or herself to an increasingly stressful situation in which frustration and panic may well take over, completely preempting, therefore, the kind of rational judgement required under such conditions.

SUMMARY OF THE INVENTION

It is the primary purpose and principle object of the present invention to provide a solution to the aforementioned problems. In particular, the present invention provides a mounting plate for a fire extinguisher which is easy to locate by virture of its markings and it peripheral shape which completely surrounds the fire extinguisher and thus subordinates the dull appearance of the fire extinguisher to the striking appearance of the plate itself and is thus a constant reminder to anyone of its location. The plate, then, and not the fire-extinguisher, according to the principles of the invention, becomes the dominant structure so far as appearance is concerned. In this way, a fire extinguisher mounted on a plate according to the invention is easily seen—it screams out to be seen—and under emergency conditions anyone confronting the prospect of securing a fire extinguisher is immediately diverted to that purpose by the striking appearance of the plate. The present invention provides, therefore, a cost-effective, simple and effective solution to the problem of locating fire extinguishers under emergency condtions.

Further, the present invention employs a striped or eye-catching design on its surface, which design is integral with the inert plastic material comprising the plate and is, therefore, relatively impervious to damage, defacement, or chemical attack, is weatherproof, will not rust, break or flake off, and is virtually maintenance-free.

According to one embodiment of the invention, a plate mounting for a fire-extinguisher is provided which is composed of a fiberglass material or a fiberglass reinforced plastic (FRP) which incorporates an eye-catching design, such as a horizontal array of red and white stripes, and which further surrounds the fire extinguisher so as to provide an arresting backdrop or backboard surface boldly outling the silhouette of the fire extinguisher. Naturally, the striped design can be varied; for example, the stripes might be vertical or diagonal, and their width might vary as well, so long as a color contrast between the stripes is maintained, such as black and white, or red and white, or black and yellow etc.

The invention will be better understood as well as further objects and advantages thereof become more apparent from the ensuing detailed description of the preferred embodiment taken in conjunction with the drawings.

DETAILED DESCRIPTION OF THE PREFERRED EMBODIMENT

Figure 1:
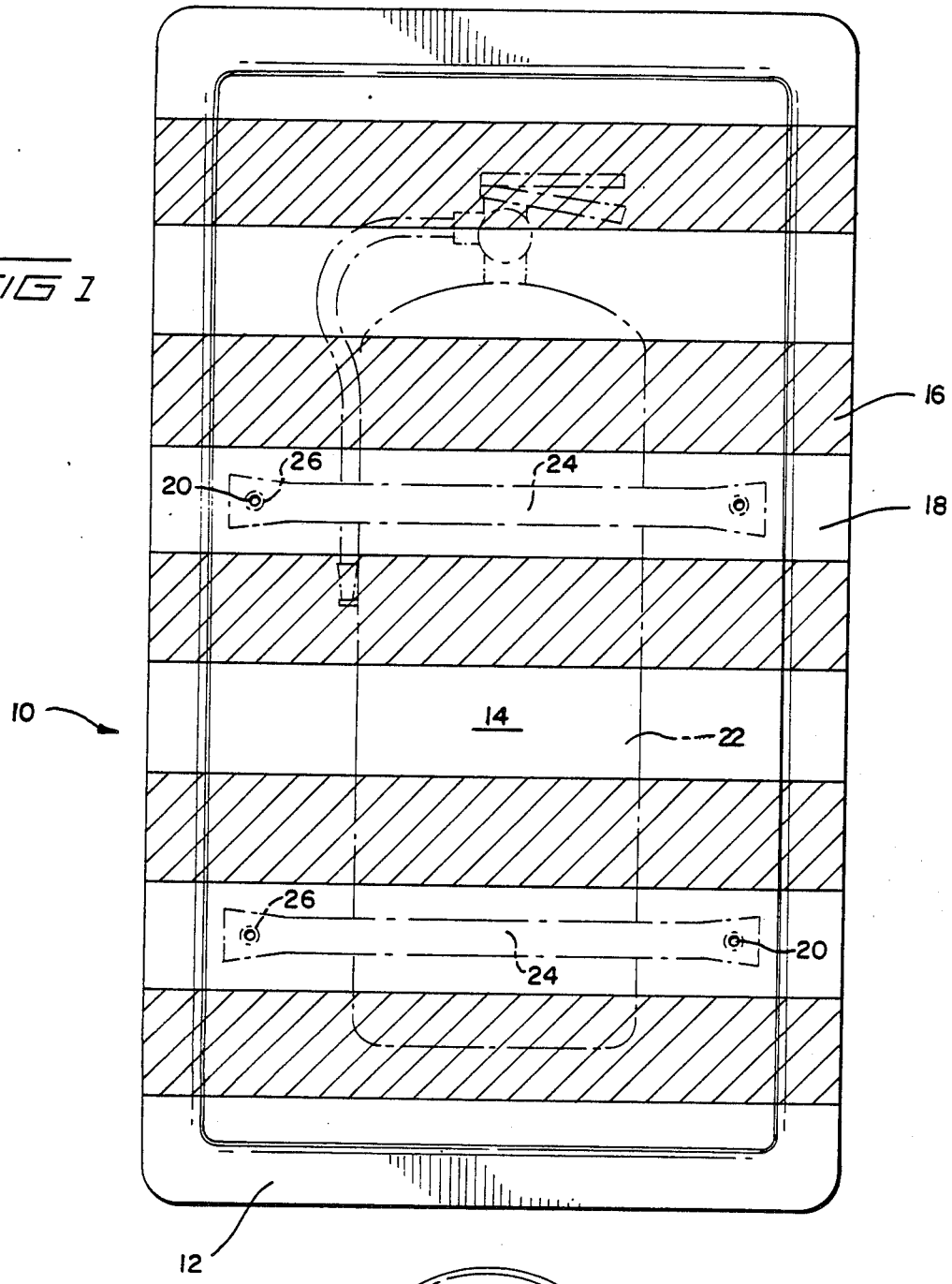
FIG. 1 is schematic elevational view of the invention shown with a fire-extinguisher.

Referring now to FIG. 1, there is shown the plate mounting 10, according to the invention, which is formed of a suitable plastic material, preferably a fiberglass or a fiberglass reinforced plastic (FRP), although it is not intended that the plate material be limited by the material used. For example, a sheet metal also could be used if it is preferred that the striped pattern not be integral with the material itself. In the case of plastic or fiberglass, however, the striped pattern will be formed as an integral part o the material, which will be more fully discussed below. The plate 10 is constituted by a rim portion 12 and a raised central portion 14 in order to facilitate the mounting of a fire extinguisher so that sufficient space is provided behind the plate 10 to accommodate the necessary nuts and bolts normally used to mount the fire extinguisher to the plate. Also shown on the face of the plate 10 is a striped pattern consisting of alternate stripes 16 and 18 of differing colors, red and white for example, although other colors which offer good contast between themselves can be used. The stripes 16 and 18 are shown to be horizontal, but a variation of this pattern can be employed without detracting from the attention provoking qualities of the design. The stripes can be diagonal, for example, or even vertical, the important factor being, of course, that the design offer a striking contrast between the colors. Any arrangement of colors, therfore, can be used so long as the colors form an alternating and contrasting pattern or arrangement.

Figure 2:
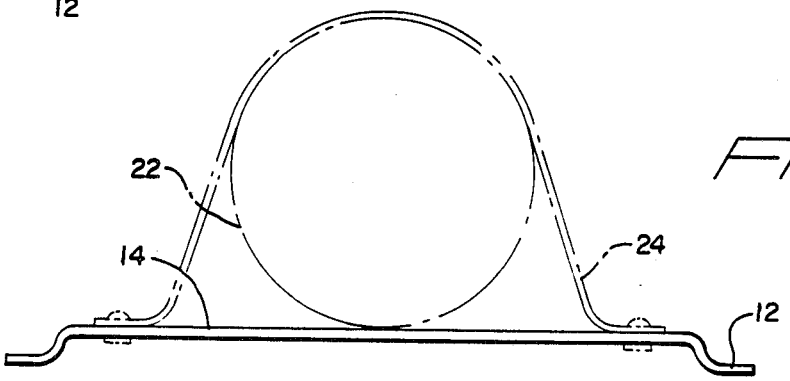
FIG. 2 is a schematic cross-sectional view of the invention.

Suitable holes 20 can be provided for accommodating the necessary bolts for attaching the fire extinguisher 22, as shown. Towards this end, suitable straps 24 may be provided as one exemplary method for attaching the fire extinguisher to the plate by means of fastening means 26 positioned in the holes 20, as best shown in FIG. 2 It is important to note here that the periphery of the plate 10 is seen to surround the fire extinguisher 22 so that a substantial portion of the plate 10 is visible and therfore serves its intended purpose of being a constant reminder to anyone within its vicinity of its location. While the plate 10 is shown to be surrounding the fire extinguisher, it should be understood that so long as a substantial portion of the plate is visible, then the plate could very well be extensive in width while being shorter in height than the fire extinguisher, or it could be extensive in height while being nearly the same width as the fire extinguisher. It also should be noted that the raised portion, as shown, is entirely surrounded by the rim portion. Thus, the hardware contained under the surface 14 is itself completely enclosed, which may be desirable in an outdoor enironment if the rim itself is used as the means, for example, by drilling, for attaching the plate to a wall-surface.

The present invention contemplates the use of a fiberglass-reinforced plastic for the plate 10 in which the colored stripes 16 and 18 are integral with the material; that is, in forming the plate 10, a gel-coat, which is a liquid resin with a thickening agent, UV inhibitor, and pigments, is first sprayed in a suitable mold structure having the over-all shape of the plate 10. The gel-coat is thus pigmented with suitable colors to give the product its striped pattern. For example, bands on the mold can be masked off so that a red gel-coat is sprayed in one band, the masking tape removed to form an adjacent band, and a white gel-coat sprayed in an adjacent band, and so on. When the gel-coat dries, a combination of fiberglass and plain resin is then laid over the gel-coat to from the final product or plate 10.

The skilled artisan is also referred to U.S. Pat. No. 4,009,225, entitled, "Low Profile Pigmented Sheet Molding Process and Product," which discusses a method of internally pigmenting a fiberglass reinforced plastic. Also, recourse can be had to U.S. Pat. No. 4,587,155, entitled, "Method of Applying a Dye Image to a Plastic Member and the Image Bearing Member Thereby Formed," for its information on pigmenting a dye internally into a plastic. Finally, U.S. Pat. No. 4,465,727, entitled, "Dye Decorated Plastic Articles," discusses a method of penetrating a plastic with one or more colors in clearly defined patterns so that the surface portion is free of any dye adhesive or dye carrier.

In the case of sheet metal being used as the material for the plate mounting 10, according to the invention, a suitable adhesive striping can be affixed to the metal surface in order to provide the striped pattern intended by the invention, or suitable stripes can be directly painted on the plate. This method might be sutable for interior environments where the plate mounting will not be subjected to weathering conditions or vandalism.

The foregoing relates to a preferred embodiment of the invention, it being understood that other embodiments and variants thereof are possible within the spirit and scope of the invention, the latter being defined by the claims.

What is claimed and desired to be secured by Letters Patent of the United States is:

1. A wall-mounting for a hand-operated fire extinguisher, comprising a plate having a substantially flat surface and having markings thereon defined by a contrasting and alternating color pattern, said fire extinguisher occupying a portion of said plate, and a substantial further portion of said plate extending in its planar dimension beyond the periphery of said fire extinguisher, whereby said markings adjacent said fire extinguisher are clearly visible.

2. A mounting for a fire extinguisher according to claim 1, wherein said markings are on one side only of said plate.

3. A mounting for a fire-extinguisher according to claim 1, where in said markings are on both sides of said plate.

4. A wall-mounting for a hand-operated fire extinguisher, comprising a plate composed substantially of a plastic material and having markings therein defined by an alternating color pattern extending across the planar dimension thereof, and a substantial portion of said plate extending in the planar dimension thereof beyond the periphery of said fire-extinguisher, whereby said markings adjacent said fire extinguisher are clearly visible.

5. A mounting for a fire-extinguisher according to claim 4, wherein said plate comprises a fiberglass reinforced plastic material.

6. A mounting for a fire extinguisher according to claim 4, where in said plate comprises a rim portion at its periphery which is offset from the remaining interior portion.

7. A wall-mounting for a hand-operated fire extinguisher, comprising a plate substantially formed of reinforced fiberglass plastic having an interior layer of plastic markings therein defined by a contrasting and alternating color pattern, and a substantial portion of said plate exending in the planar dimension thereof beyond the periphery of said fire extinguisher, whereby said markings adjacent said fire extinguisher are clearly visible.

* * * * *